United States Patent [19]

Reed et al.

[11] 4,084,935

[45] Apr. 18, 1978

[54] SMOKE SUPPRESSANT MIXER FOR FLARED GASES

[75] Inventors: Robert D. Reed; Robert E. Schwartz, both of Tulsa, Okla.

[73] Assignee: John Zink Company, Tulsa, Okla.

[21] Appl. No.: 666,958

[22] Filed: Mar. 15, 1976

[51] Int. Cl.[2] ..... F23D 13/20

[52] U.S. Cl. ..... 431/202; 23/277 C; 431/5

[58] Field of Search ..... 431/202, 5, 190, 4; 23/277 C

[56] References Cited

U.S. PATENT DOCUMENTS

| | | | |
|---|---|---|---|
| 3,429,645 | 2/1969 | Reed | 431/202 |
| 3,539,285 | 11/1970 | Zink et al. | 431/202 |
| 3,817,695 | 6/1974 | Reed et al. | 431/202 |
| 3,973,899 | 8/1976 | Reed et al. | 431/202 |

*Primary Examiner*—Edward G. Favors

*Attorney, Agent, or Firm*—Head, Johnson & Chafin

[57] ABSTRACT

An improved flare stack for the smokeless burning of smoke prone fuel gases, comprising a cylindrical flare stack, an inner cylindrical conduit which is closed at its bottom end and positioned with its top at substantially the same elevation as the top of the flare stack. The flow of the smoke-prone fuel gas up the stack is diverted into the annular space between the inner conduit and the flare stack, providing an annular flow of fuel gas. Smoke suppressant, such as a mixture of steam and air, is conducted into the inner conduit and vertically upwardly to the top thereof from which it can either continue unaltered flow direction or it can be diverted outwardly and upwardly into the inner wall of the annular flow of gas, to provide quick and intimate mixing of the smoke suppressant with the fuel gas. Additionally, smoke suppressant can be injected inwardly into the outer wall of the annular flow of fuel gas, to provide additional intimate mixing of smoke suppressant, to provide smoke-free combustion of the fuel gases.

10 Claims, 4 Drawing Figures

SMOKE SUPPRESSANT MIXER FOR FLARED GASES

BACKGROUND OF THE INVENTION

This invention lies in the field of smokeless combustion in emergency relief flaring of smoke-prone gases. More particularly it is concerned with the construction of the flare stack and the manner of providing the flow of smoke suppressant to the smoke-prone fuel gases, to ensure complete smokeless combustion.

In the prior art, it has been customary to provide a flow of smoke suppressant, such as a mixture of steam and air, by injection radially inwardly and upwardly from outside of the perimeter of cylindrical flow of fuel gas, out of the top of a flare stack. While high velocity injection of the steam and air can be provided, but because of the large cross-sectional area of the flare stack, it is difficult to get complete penetration of the smoke suppressant into the center of the column of gas, so as to ensure complete smoke suppression.

SUMMARY OF THE INVENTION

It is a primary object of this invention to provide an apparatus for delivery of smoke suppressant to a flowing stream of smoke-prone fuel gases, so as to ensure complete smokeless combustion of the fuel gases.

This and other objects are realized and the limitations of the prior art are overcome in this invention, by providing a flare stack in which the flow of smoke-prone fuel gases is in the form of an annular flow, between a central inner conduit, and the wall of the flare stack itself. The smoke suppressant is generated and introduced into the central conduit and flows up the central conduit to its upper end, where it can be diverted so as to flow outwardly and/or upwardly, into the inner wall of the rising annular column of fuel gas, so as to mix therewith. Additional smoke suppressant can be provided by conventional means from the outside of the rising annular column of fuel so that the combination of smoke suppressant flowing outwardly through the inner wall, and inwardly through the outer wall, of the annular column of fuel, will ensure complete mixing prior to combustion and therefore complete smoke suppression.

BRIEF DESCRIPTION OF THE DRAWINGS

This and other objects and advantages of this invention and a better understanding of the principles and details of the invention will be evident from the following description taken in conjuction with the appended drawings, in which.

DESCRIPTION OF THE PREFERRED EMBODIMENT

Briefly stated, the apparatus of this invention comprises a flare stack which is vertically cylindrical in construction and preferably circular in cross-section, although, it may be of any cross-section, for control of the vertical flow of a smoke-prone fuel gas to be burned in the flare. The upward flow of the fuel gas in the stack is diverted into an annular flow, by means of an inner cylindrical conduit, supported inside of the flare stack, with its top at the same elevation as the top of the flare stack. Means are provided to flow smoke suppressant, such as a mixture of air and steam, upwardly through the inner conduit. This flow at the upper end of the conduit can be diverted by means of a partial obstruction, over the center of the conduit, to flow outwardly and upwardly into the inner wall of the annular flow of the fuel gas, and to intimately mix therewith, so as to provide smokeless combustion to best advantage, but the partial obstruction is not demanded for enhancement of smokeless combustion.

Figure 1:
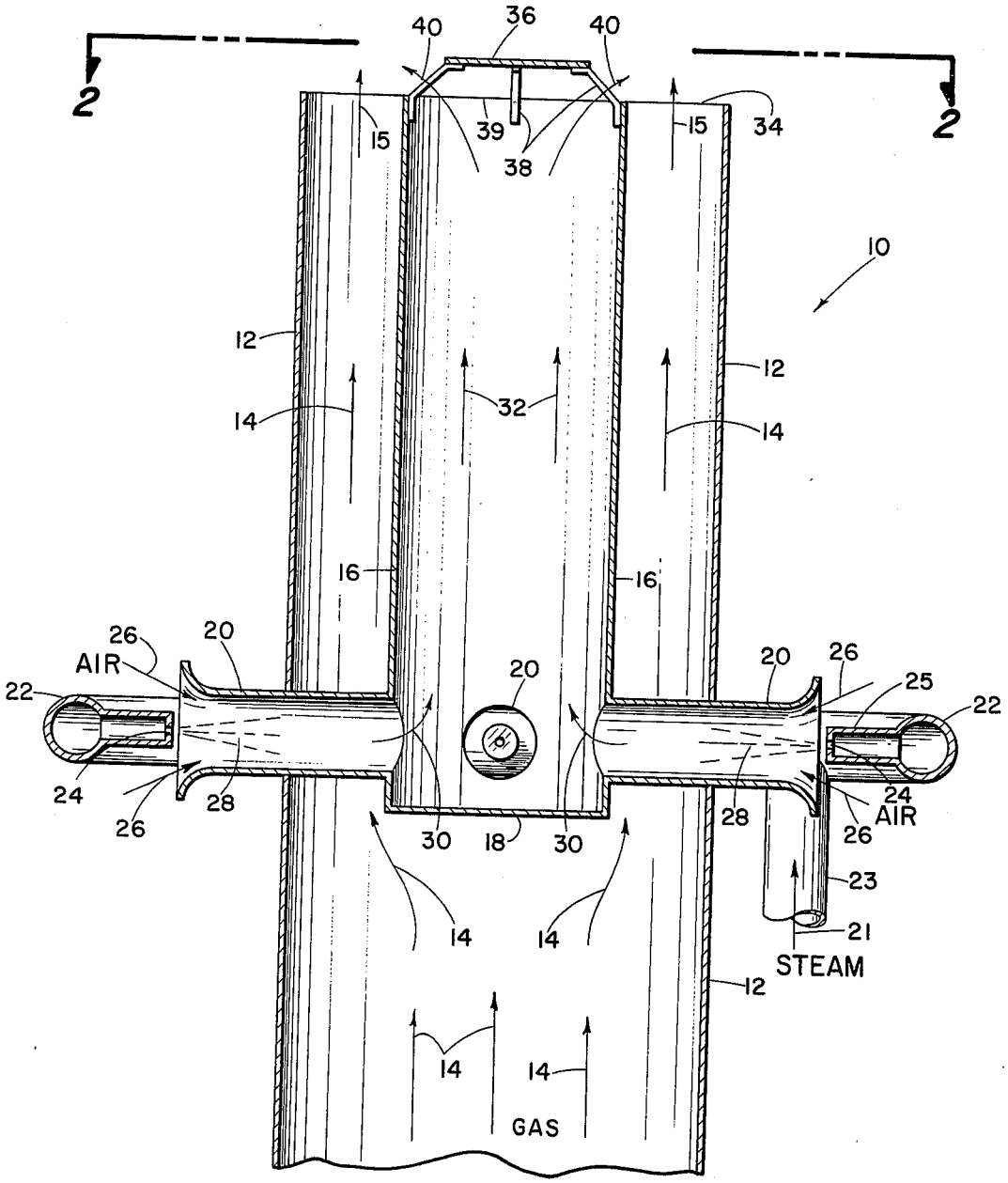
FIG. 1 illustrates in vertical cross-section one embodiment of this invention.
Figure 2:
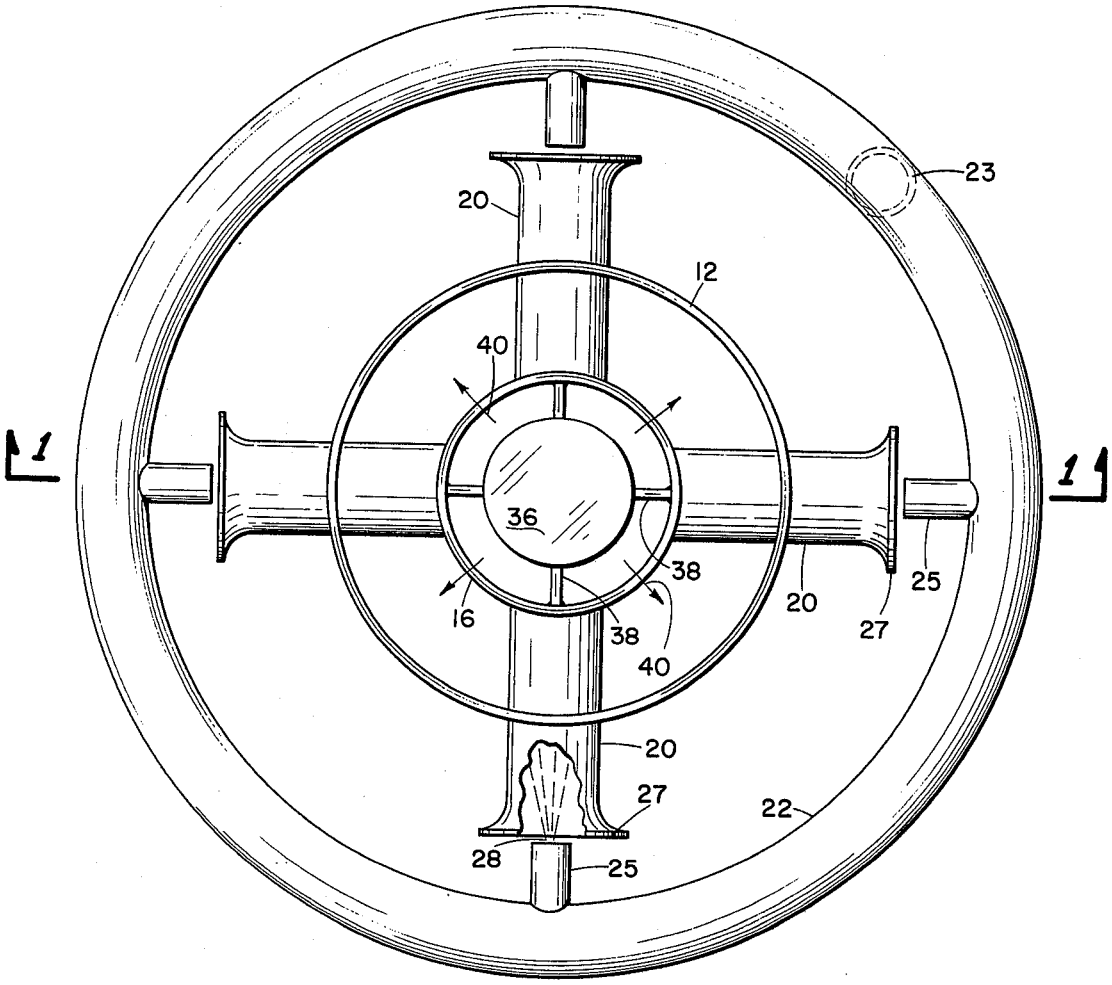
FIG. 2 illustrates a plan view taken along plane 2-2 of FIG. 1.

In the drawings, numeral 10 indicates generally the apparatus of this invention, which is shown in the form of a vertical cross-section, taken along the plane 1-1 of FIG. 2. The flare stack 12 is shown as a circular cylindrical conduit. The central portion is closed off by an inner circular conduit 16 which is preferably co-axial with the stack 12. This inner conduit 16 is closed off by a plate 18 at the bottom, and includes a plurality of radial pipes 20 which pass through the wall of the inner conduit and through the wall of the stack 12 to the outside. There is a circular manifold 22 connected to a vertical pipe 23 through which steam or finely divided water droplets flow in accordance with arrows 21. There are a plurality of radial orifices 24 on extension tubes 25 which inject a high velocity stream of steam 28 into the ends of these radial pipes 20. The flow of the jet streams 28 induces an inward flow of air, in accordance with arrows 26, which mixes with the steam, and together the mixture flows in accordance with arrows 30 and 32 up through the inner conduit 16 to its top portion.

Across the top of the inner conduit is positioned a baffle plate 36 which is centrally positioned above the top end 39 of the inner conduit, by means of a plurality of brackets 38. These may be welded 48 to the conduit 16 and to the plate 36. The open area 50 for the flow in accordance with arrows 40 of the mixture of air and steam, is in the form of a conical surface, the conical angle of which, is in the range of 60°-90°. The conical opening 50 is at such an angle, that the flow of air and steam 40 will be radially outwardly and upwardly, into the inner wall 56 of the rising annular column of fuel gas 52. The smoke suppressant 40 will mix intimately with the gas 52 as it penetrates the inside wall 56. Again, the baffle plate 36 is a preferred, but not a required element.

Correspondingly, as is well known in the art, there can be additional injections of smoke suppressant radially inwardly from nozzles on the outside of the outer wall 54 of the rising column 52. This is illustrated simply by the nozzle 58 on bracket 60 providing steam jet 62.

Figure 4:
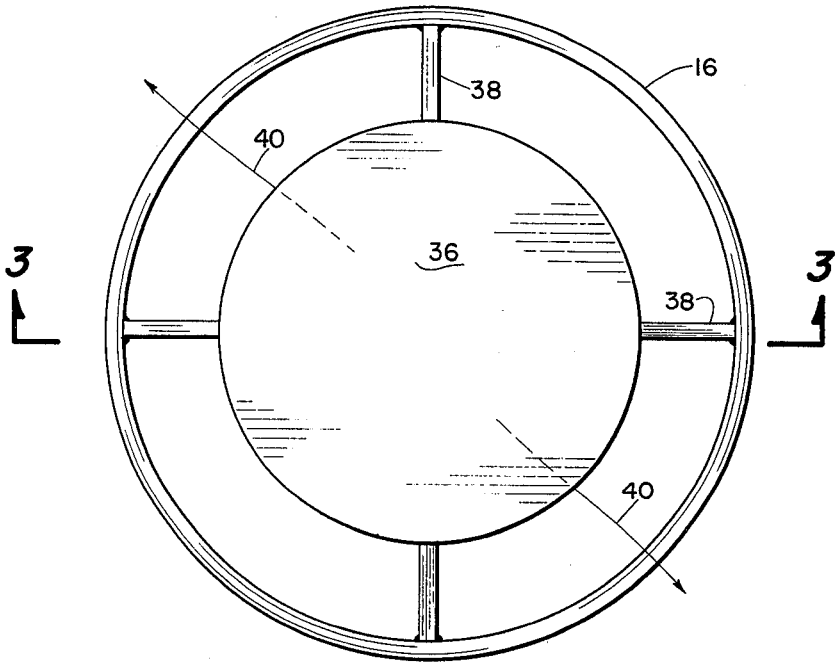
FIGS. 3 and 4 provide elevation and plan details of the top of the inner conduit, including the means for diverting the flow of smoke suppressant radially outwardly and upwardly into the rising column of gaseous fuel.
Figure 3:
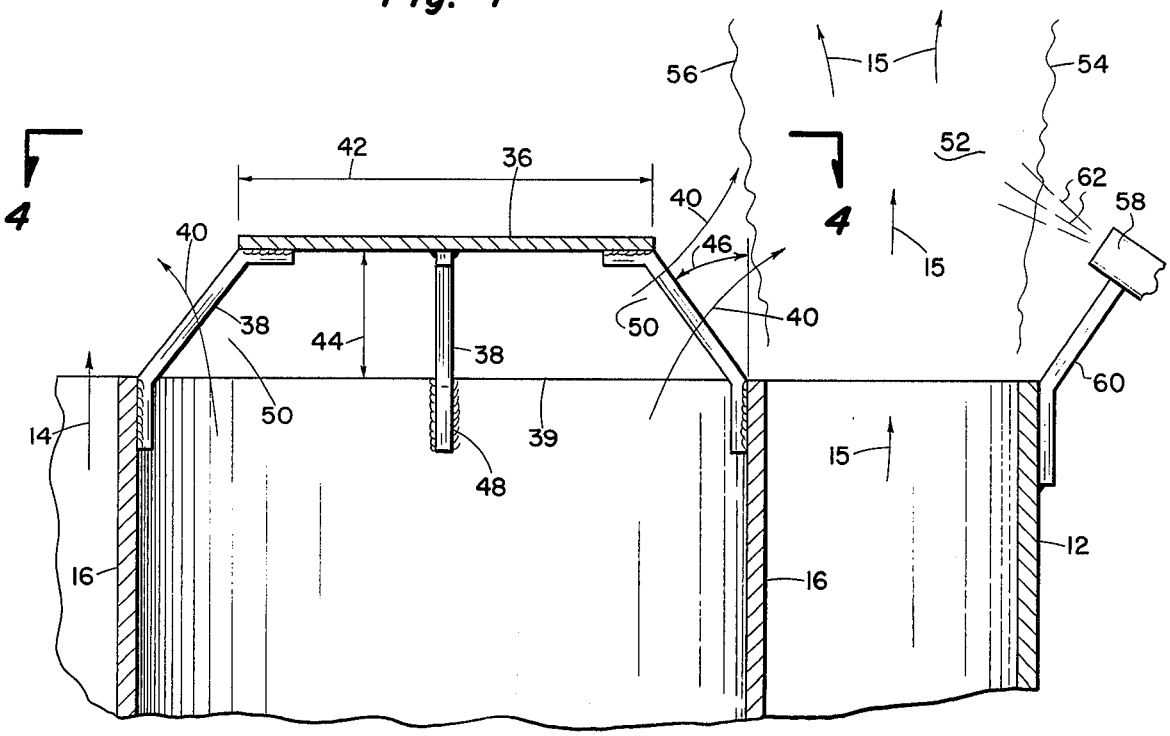

Detail of the construction of the top end of the inner conduit and the diverting plate 36 etc. is shown more clearly in FIGS. 3 and 4. As for a typical size, the pipe or conduit 16 might be 12 inches in diameter, for example, with the diameter 42 of the plate 36 in the range of about 8-9 inches, and the elevation of the plate 36 above the top edge 39 of the conduit 16 about 2 ½ inches. That would provide a total conical angle of the outlet opening 50 in the range of about 60° to 90°. This is not a critical dimension. However, it is important that the flow of smoke suppressant be diverted outwardly so as to thoroughly mix with the rising column of fuel 52.

While FIG. 2 shows the use of four radial pipes 20 for the injection of steam and air into the central conduit, there can be any desired number of such side pipes for supplying the smoke suppressant, and the number four is shown only for purpose of illustration. Also the radial pipes 20 can be flared on the outer end 27, as is well known in the art, to provide for the injection of a maximum volume of air for combustion with the fuel gas, by entrainment with the steam into the flows 30, 32, and 40 into the wall 56 of the column 52 of fuel gas.

It will be clear from the description of the apparatus illustrated in the drawings that by confining the flow of fuel gas to a column of gas that is narrow radially, the penetration from the inner wall 56 of the smoke suppressant 40, and the penetration through the outer wall 54 of additional smoke suppressant such as steam and air, will clearly make it possible to obtain full penetration of the column of fuel gas, so as to ensure the adequate mixing of smoke suppressant with the fuel, in order to get a truly smokeless combustion.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. In an apparatus for smoke-suppression of flare-burned smoke-prone fuels, including:

a. a flare stack conduit for vertical flow of smoke-prone fuel gases to be burned above the outlet tip thereof; and a supply of smoke suppressant; the improvement comprising:

b. inner conduit means inside of said flare stack, for confining the total flow of said fuel gas to the annular space between said inner conduit means and said stack as a rising cylindrical wall of gas, said inner conduit having a closed upstream end and an open downstream end;

c. said inner conduit adapted to flow the major part of said smoke suppressant upwardly in said inner conduit means and through said open end for juncture with said fuel gases; and including means at the outlet end of said inner conduit means to divert said smoke suppressant outwardly and upwardly toward and into the inner surface of said cylindrical wall of gas, for intimate mixing therewith.

2. The apparatus as in claim 1 including means on the outer periphery of said flare stack at its top, for injecting smoke suppressant radially inwardly and upwardly into the outer surface of said cylindrical wall of gas, for intimate mixing therewith.

3. The apparatus as in claim 1 in which said flare stack and inner conduit are circular and coaxial.

4. The apparatus as in claim 1 in which said means to divert said smoke suppressant comprises a transverse plate of smaller diameter than said inner conduit, said plate mounted above the top of said conduit, whereby the outlet area is represented by a conical surface, whereby the flow of smoke suppressant is upwardly and outwardly through said conical opening.

5. The apparatus as in claim 4 in which the conical angle of said conical surface is in the range of 45° to 90°.

6. The apparatus as in claim 1 in which the tops of said inner conduit and said flare stack are at substantially the same elevation.

7. The apparatus as in claim 1 in which said smoke suppressant is a mixture of steam and air or finely divided water droplets.

8. The apparatus as in claim 7 including steam manifold means encircling said stack; at least one radial pipe passing through said stack into said inner conduit means; at least one orifice in said manifold directing at least one jet of steam into said at least one radial pipe; whereby air is induced into said at least one pipe to mix with said steam and to flow up said inner conduit means to the outlet thereof.

9. The apparatus as in claim 8 including a flared outer end on said at least one radial pipe.

10. In an apparatus for smoke-suppression of flare-burned smoke-prone fuels, including:

a. a cylindrical flare stack conduit for vertical flow of smoke-prone fuel gases to be burned above the outlet tip thereof;

the improvement comprising:

b. inner conduit means inside of said flare stack, for confining the flow of said fuel gas to the annular space between said inner conduit means and said stack as a rising cylindrical wall of gas, the thickness of said wall being a minor fraction of the radius of said stack;

c. means to flow a substantial part of the total smoke suppressant up said inner conduit, and to divert said smoke suppressant outwardly and upwardly into the inner surface of said rising cylindrical wall of gas, for intimately mixing therewith; and d. means on the outer periphery of said flare stack at its top, for injecting smoke suppressant radially inwardly and upwardly into the outer surface of said cylindrical wall of gas for intimate mixing therewith.

* * * * *